US009902152B2

(12) United States Patent
Eid et al.

(10) Patent No.: US 9,902,152 B2
(45) Date of Patent: Feb. 27, 2018

(54) PIEZOELECTRIC PACKAGE-INTEGRATED SYNTHETIC JET DEVICES

(71) Applicant: Intel Corporation, Santa Clara, CA (US)

(72) Inventors: Feras Eid, Chandler, AZ (US); Shawna M. Liff, Scottsdale, AZ (US); Sasha N. Oster, Chandler, AZ (US); Thomas L. Sounart, Chandler, AZ (US); Georgios C. Dogiamis, Chandler, AZ (US); Adel A. Elsherbini, Chandler, AZ (US); Johanna M. Swan, Scottsdale, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/199,899

(22) Filed: Jun. 30, 2016

(65) Prior Publication Data

US 2018/0001640 A1 Jan. 4, 2018

(51) Int. Cl.
*B41J 2/14* (2006.01)

(52) U.S. Cl.
CPC ..... *B41J 2/14298* (2013.01); *B41J 2/14201* (2013.01); *B41J 2/14233* (2013.01); *B41J 2002/14266* (2013.01)

(58) Field of Classification Search
CPC ..... B41J 2/14298; B41J 2/14201; B41J 2/14233; B41J 2002/14266
See application file for complete search history.

(56) References Cited

U.S. PATENT DOCUMENTS

2002/0075362 A1* 6/2002 Nakamura ..... B41J 2/14233 347/68
2005/0134144 A1* 6/2005 Buhler ..... B41J 2/14233 310/317
2005/0275695 A1* 12/2005 Murata ..... B41J 2/14233 347/70
2011/0038495 A1* 2/2011 Jeong ..... H04R 17/00 381/190

* cited by examiner

*Primary Examiner* — Geoffrey Mruk
(74) *Attorney, Agent, or Firm* — Schwabe, Williamson & Wyatt, P.C.

(57) ABSTRACT

Embodiments of the invention include a piezoelectric package integrated jet device. In one example, the jet device includes a vibrating membrane positioned between first and second cavities of an organic substrate, a piezoelectric material coupled to the vibrating membrane which acts as a first electrode, and a second electrode in contact with the piezoelectric material. The vibrating membrane generates fluid flow through an orifice in response to application of an electrical signal between the first and second electrodes.

20 Claims, 8 Drawing Sheets

PIEZOELECTRIC PACKAGE-INTEGRATED SYNTHETIC JET DEVICES

FIELD OF THE INVENTION

Embodiments of the present invention relate generally to package integrated synthetic jet devices. In particular, embodiments of the present invention relate to piezoelectric package integrated synthetic jet devices.

BACKGROUND OF THE INVENTION

In a traditional approach, fans and blowers are used to create air flow. However, fans and blowers are very inefficient air movers when scaling down to very small sizes (e.g., millimeter (mm) scale). Micro-scale synthetic jet devices have been considered in the past with silicon micromachining; however their fabrication utilizing that approach, which requires micromachining of expensive materials, is cost-prohibitive.

DETAILED DESCRIPTION OF THE INVENTION

Figure 1:
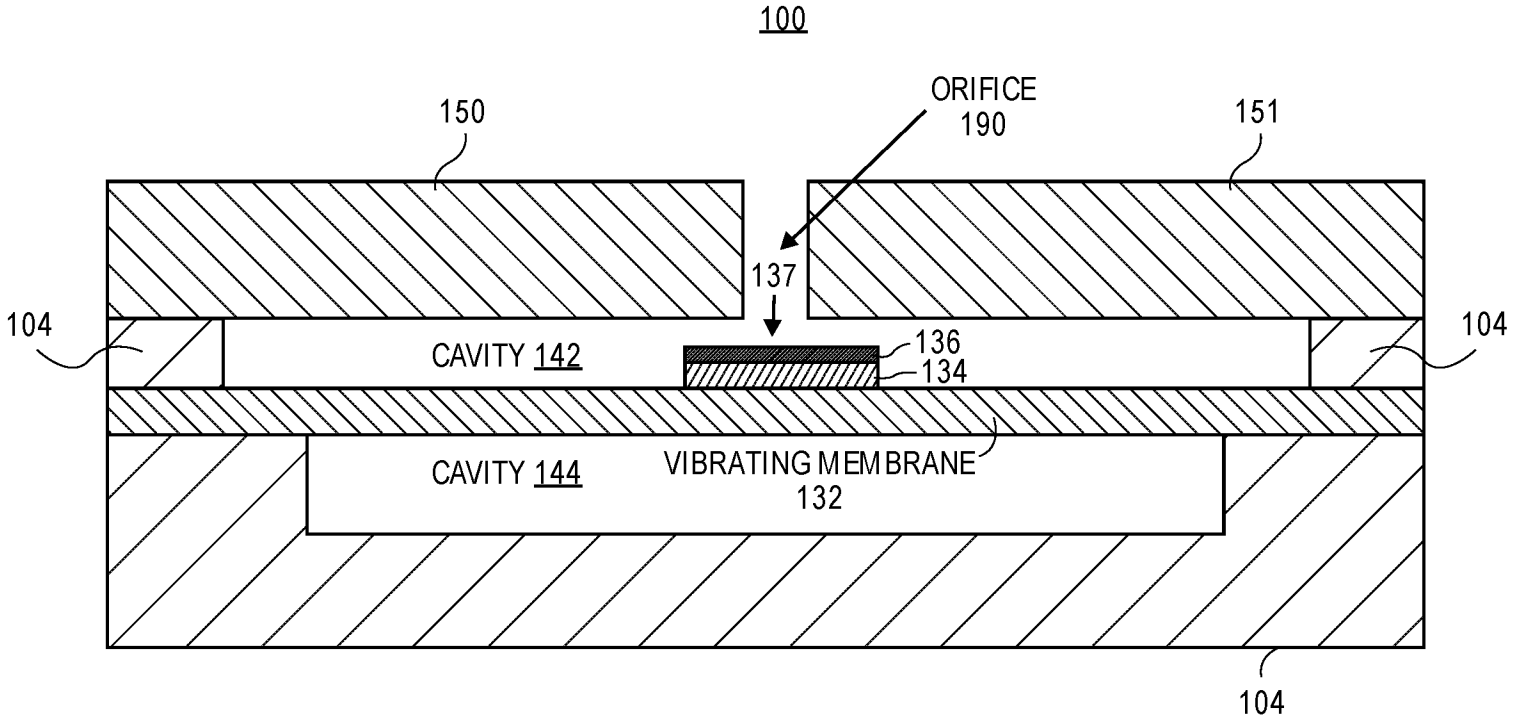
FIG. 1 illustrates a cross-sectional view of a synthetic jet device in accordance with one embodiment.

Described herein are piezoelectric package integrated synthetic jet devices in a package substrate. In the following description, various aspects of the illustrative implementations will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative implementations. However, it will be apparent to one skilled in the art that the present invention may be practiced without the specific details. In other instances, well-known features are omitted or simplified in order to not obscure the illustrative implementations.

Various operations will be described as multiple discrete operations, in turn, in a manner that is most helpful in understanding the present invention; however, the order of description should not be construed to imply that these operations are necessarily order dependent. In particular, these operations need not be performed in the order of presentation.

The present design includes a package-based synthetic jet device technology to enable delivery of a controlled fluid flow which can be measured as an amount of fluid per unit of time that flows through a particular device. A synthetic jet device includes a vibrating membrane that is enclosed in a cavity with an orifice. As the membrane vibrates, "puffs" of fluid are expelled through the orifice, and these puffs entrain surrounding fluid and generate a fluid jet. This fluid flow can be used for environmental monitoring and thermal management applications. For example, generating a controlled airflow is a requirement in environmental sensing applications in order to detect accurate concentrations of particles, pollutants, and/or toxic gases in a given environment. This functionality is in high demand for new devices such as wearables and internet of things (IoT) systems. Another application is to create localized airflow for the thermal management of processor packages. Even a small airflow can be beneficial to reduce hot spot temperatures and to generate a more even temperature distribution. By implementing the synthetic jet device on the package close to the hot components (e.g., a processor), the pulsating airflow generated can be used to break-up the thermal boundary layer and to enhance the cooling capacity allowing for higher power workloads. Yet another application may include the use of the released jets or puffs of fluid to provide haptic or tactile feedback to the user in systems such as wearable devices, keyboard keys, etc. The technology proposed in this present design enables the creation of package-integrated synthetic jet devices to generate airflow for these types of applications.

The present design includes an architecture that allows in-situ fabrication of synthetic jet devices or pumping devices in a compact form factor on package substrates using organic panel-level (e.g., approximately 0.5 m×0.5 m sized panels) high volume manufacturing technology, without requiring the assembly of external bulky components or expensive Si MEMS fabrication.

The present design addresses the fabrication of synthetic jet devices within the semiconductor package substrate that is compatible with high volume package substrate fabrication technology. This present design for synthetic jet devices integrated in a package substrate is based on our ability to deposit high quality piezoelectric materials in the package substrate and create vibrating structures in the substrate.

In one embodiment, this technology allows the fabrication of micro-electromechanical piezoelectric jet or pump devices utilizing substrate manufacturing technology. These jet or pump devices include suspended vibrating structures. The structures contain stacks of piezoelectric material and electrodes that can be used to apply an electrical signal (e.g., a voltage) to the piezoelectric layer. Applying a time-varying (e.g., AC) voltage across the electrodes produces a stress in the piezoelectric material, causing the stack, and thus the entire released structure to deform and produce alternating upward and downward vibration of a membrane. In the downward motion, fluid is sucked in from the environment. In the upward motion, "puffs" of fluid are generated and expelled through the orifice. These puffs entrain surrounding fluid along the way, creating a net outflow away from the orifice. By designing the system so that a Helmholtz frequency of the upper cavity matches the resonant frequency of the membrane and the frequency of the drive voltage applied to the piezoelectric stack, the generated fluid flow can be maximized. It may be desired to keep this frequency above audible levels (e.g., greater than 20 kHz) to achieve "quiet" operation of the system.

The present design results in package-integrated jet micro-pump devices, thus enabling smaller and thinner systems in comparison to discrete pump devices attached to a substrate. The package-integrated jet micro-pump devices do not add a Z height (along the vertical axis) to a total height of a substrate or multiple substrates. This present design can be manufactured as part of the package substrate fabrication process with no need for purchasing and assembling discrete components. It therefore enables high volume manufacturability (and thus lower costs) of systems that need jet micro-pump devices. In one example, the present design provides small scale, accurate sensing and detection of concentrations for air quality and mixtures. To be able to deliver accurate concentrations, a controlled flow rate is required. The jet micro-pump device described herein provides a controlled flow rate.

Air movement can also be used to enhance device and/or hotspot cooling in computing devices. In one example, air movement can be particularly beneficial in cooling devices which otherwise do not employ alternative means of active thermal management (e.g., smartphones and tablets). This air movement can be especially advantageous when placed close to electronic components having a high temperature.

In one example, the present design includes package-integrated structures to act as jet micro-pump devices. Those structures are manufactured as part of the package layers and air/solid interfaces are created by removing the dielectric material around those structures. The structures include piezoelectric stacks that are deposited and patterned layer-by-layer into the package stackup. The present design includes creating functional jet micro-pumps in the package on the principle of suspended and vibrating structures. The package build-up dielectric material may be selectively removed to create vacuum-filled or air-filled cavities. Piezoelectric material deposition (e.g., 0.5 to 1 um deposition thickness) and crystallization also occurs in the package substrate during the package fabrication process. An annealing operation at a substrate temperature range (e.g., up to 260 C) that is lower than typically used for piezoelectric material annealing allows crystallization of the piezoelectric material (e.g., lead zirconate titanate (PZT), potassium sodium niobate (KNN), aluminum nitride (AlN), zinc oxide (ZnO), etc) to occur during the package fabrication process without imparting thermal degradation or damage to the substrate layers. In one example, laser pulsed annealing occurs locally with respect to the piezoelectric material without damaging other layers of the package substrate including organic layers.

FIG. 1 illustrates a cross-sectional view of a synthetic jet device in accordance with one embodiment. A synthetic jet device 100 includes a vibrating membrane 132 formed in a cavity 142 and a cavity 144 of an organic substrate having organic dielectric layers 104. The vibrating membrane generates "puffs" of fluid (e.g., air), which are expelled through the orifice 190. The jet flow is generated by entraining surrounding fluid with the puff. This present design provides a description of creating synthetic jet devices directly in the package substrate and actuating those devices using piezoelectric films that are deposited and patterned in the package substrate.

The membrane 132 is free to vibrate in a vertical direction (z-axis) and is surrounded by cavities on both sides (top and bottom). The membrane 132 can be patterned as part of one of the substrate conductive trace layers and can include copper or other conductive material. Organic dielectric normally surrounds copper traces in packages/PCBs; however this organic material is removed around the membrane in FIG. 1 to allow the membrane 132 to move. To actuate the membrane 132, a piezoelectric stack 137 is deposited and patterned as shown. The stack 137 includes a piezoelectric material 134 (e.g., PZT, KNN, ZnO) or other materials sandwiched between conductive electrodes 132 and 136. The membrane 132 itself can be used as one of the electrodes as shown in FIG. 1, or alternatively, a separate conductive material can be used for this electrode after depositing an insulating layer to electrically decouple this electrode from the conductive membrane. The next trace layer containing traces 150, 151 (above the membrane layer 132) has an orifice 190 through which the flow is sucked in and expelled. To drive the membrane 132, a time varying (e.g., sinusoidal, square wave, etc) voltage signal is applied between the electrodes 132 and 136 to the piezoelectric material 134, causing the piezoelectric material to deform and producing alternating upward and downward vibration of the membrane. In the downward motion, fluid is sucked in from the environment. In the upward motion, "puffs" of fluid are generated and expelled through the orifice, entraining surrounding fluid during the process.

The synthetic jet devices deliver relatively large flow rates even for very small (e.g., mm scale) device sizes. Therefore, synthetic jet devices are desirable when in need of large flow rates, especially in size constrained applications. This makes the synthetic jets the desired technology for delivering controlled flows to sensor locations especially in platforms in which a small form factor is required (e.g., wearables, smartphones, tablets, etc.). The mm-scale synthetic jet devices can also provide airflow in very thin air gaps to increase cooling capacity in regions where airflow has previously not been generated. The pulsating flow from synthetic jet devices provides a well suited flow to break up thermal boundary layers to create a more uniform temperature distribution. Synthetic jet devices are not limited to air movement. They can also generate jet movement in any fluid.

Micro-scale synthetic jet devices have been only considered in the past in the context of Si micromachining. The present design uses panel-level organic substrate technology instead of wafer-level silicon micromachining to create those devices. Package substrate technology using panel-level processes has significant cost advantages compared to Silicon-based MEMS processes since it allows the batch fabrication of more devices using less expensive materials. However, the deposition of high quality piezoelectric thin films has been traditionally limited to inorganic substrates such as silicon and other ceramics due to their ability to withstand the high temperatures required for crystallizing those films. The present design is enabled by a new process to allow the deposition and crystallization of high quality piezoelectric thin films without degrading the organic substrate.

Compared to using a discrete micro-pump that is assembled to the package or system, the present design allows tighter integration and a more compact form factor since the pump is directly created as part of the substrate itself with no need for assembling external components. Compared to using an electromagnetic approach to actuate the pump, the present design offers much lower power consumption and does not require the assembly of an external component such as a magnet to provide the necessary magnetic field.

Figure 2:
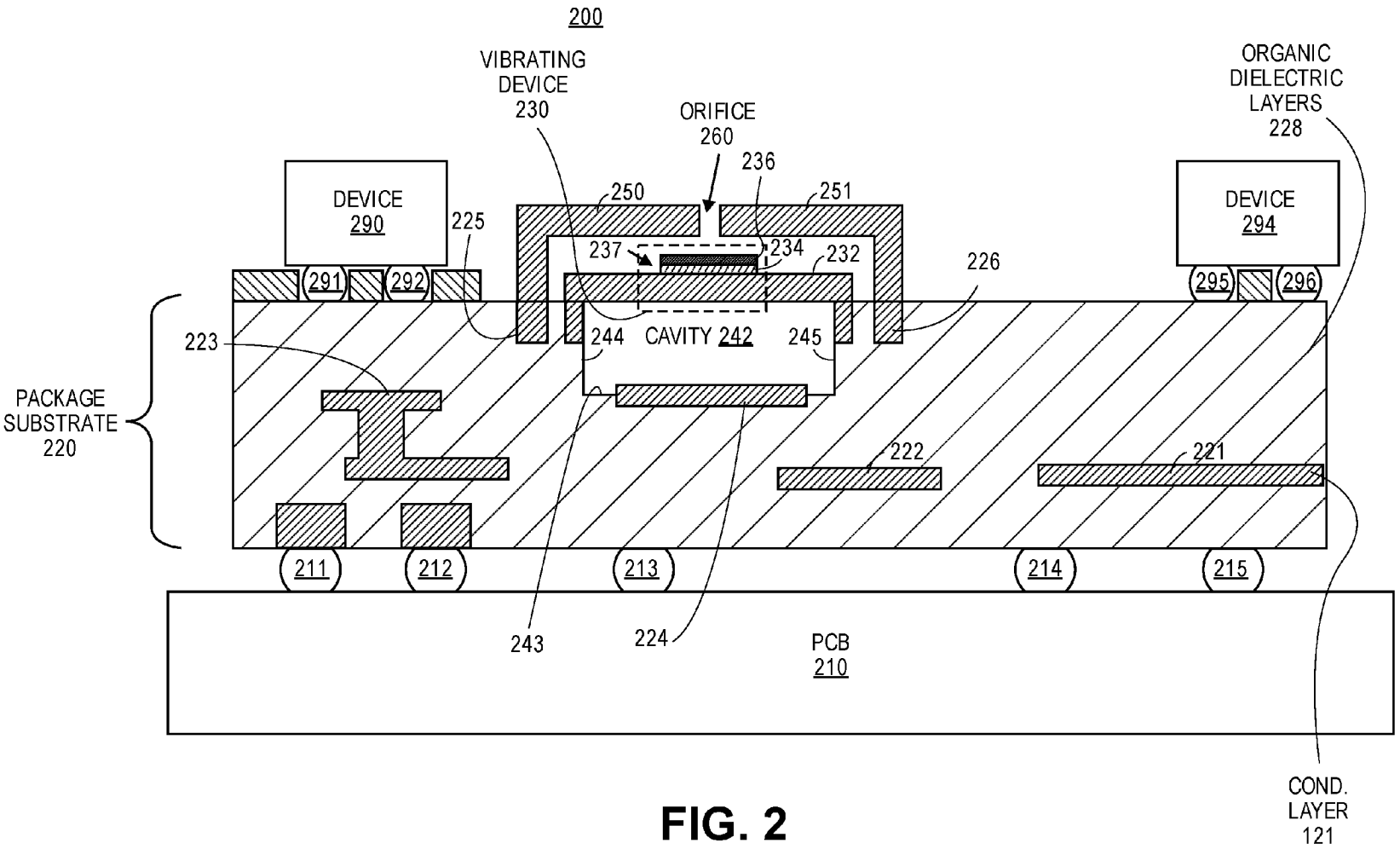
FIG. 2, a view of a microelectronic device 200 having a package-integrated piezoelectric jet device is shown, according to an embodiment.

Referring now to FIG. 2, a view of a microelectronic device 200 having a package-integrated piezoelectric jet device is shown, according to an embodiment. In one example, the microelectronic device 200 includes multiple devices 290 and 294 (e.g., die, chip, CPU, silicon die or chip, radio transceiver, etc.) that are coupled or attached to a package substrate 220 with solder balls 291-292, 295-296. The package substrate 220 is coupled or attached to the printed circuit board (PCB) 210 using, for example, solder balls 211 through 215.

The package substrate 220 (e.g., organic substrate) includes organic dielectric layers 228 and conductive layers 221-226, 232, 236, 250, and 251. Organic materials may include any type of organic material such as flame retardant 4 (FR4), resin-filled polymers, prepreg (e.g., pre impregnated, fiber weave impregnated with a resin bonding agent) polymers, silica-filled polymers, etc. The package substrate 220 can be formed during package substrate processing (e.g., at panel level). The panels formed can be large (e.g., having in-plane dimensions of approximately 0.5 meter by 0.5 meter, or greater than 0.5 meter, etc.) for lower cost. A cavity 242 is formed within the packaging substrate 220 by removing one or more layers (e.g., organic layers, dielectric layers, etc.) from the packaging substrate 220. The cavity 242 includes a lower member 243 and sidewalls 244-245. In one example, a piezoelectric vibrating device 230 is formed with conductive structures 232 and 236 (e.g., cantilevers, beams) and piezoelectric material 234. The three structures 232, 234, and 236 form a stack 237. The conductive structure 232 can act as a first electrode and the conductive structure 236 can act as a second electrode of the piezoelectric vibrating device. The cavity 242 can be air filled or vacuum filled. Applying a voltage across the first and second electrodes causes the stack to be mechanically deformed due to the piezoelectric effect and produces alternating upward and downward vibration of the conductive structure 232 (membrane). In the downward motion, fluid is sucked in from the environment via the orifice 260. In the upward motion, "puffs" of fluid are generated and expelled through the orifice 260, entraining surrounding fluid during this process.

Figure 3A:
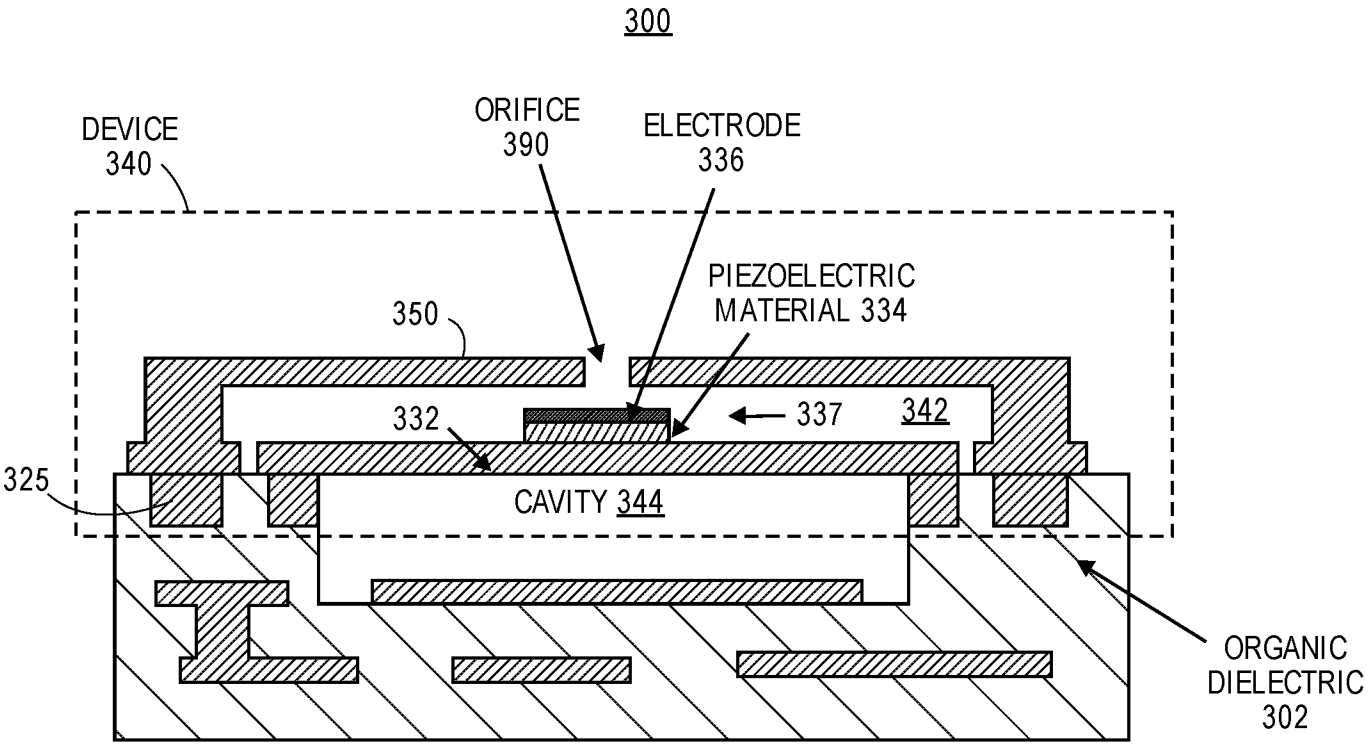
FIG. 3A illustrates a cross-sectional view of a synthetic jet device integrated in a package substrate in accordance with one embodiment.

FIG. 3A illustrates a cross-sectional view of a synthetic jet device integrated in a package substrate in accordance with one embodiment. A package substrate 300 includes synthetic jet device 340 for generating fluid flow. The device 340 includes a vibrating membrane 332 formed in a cavity 342 and a cavity 344 of an organic substrate 300 having organic dielectric material 302. The vibrating membrane 332 generates "puffs" of fluid, which are expelled through the orifice 390. The jet flow is generated by entraining surrounding fluid with the puff.

Figure 3B:
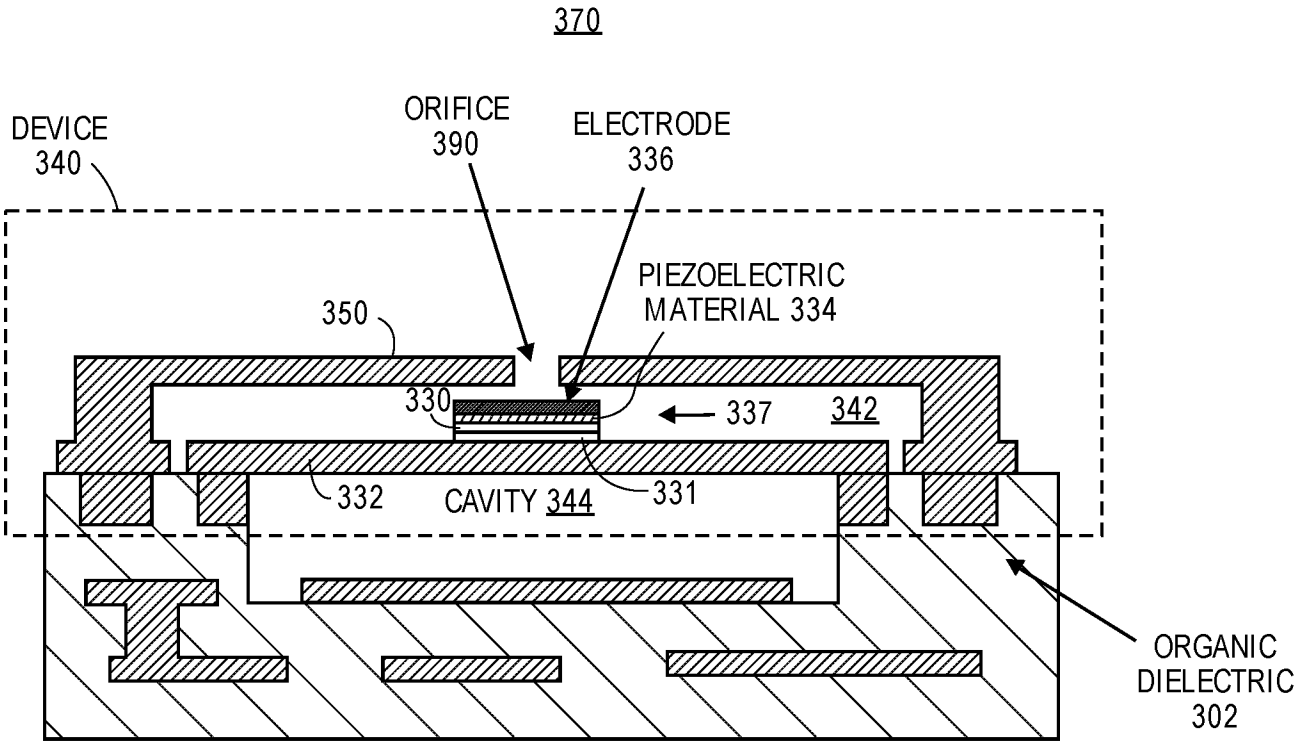
FIG. 3B illustrates a cross-sectional view of a synthetic jet device integrated in a package substrate in accordance with another embodiment.

The membrane 332 is free to vibrate in a vertical direction (z-axis) and is surrounded by cavities on both sides (top and bottom). The membrane 332 can be patterned as part of one of the substrate conductive trace layers and can include copper or other conductive material. Organic dielectric normally surrounds copper traces in packages/PCBs; however this organic material is removed around the membrane in FIG. 3A to allow the membrane 332 to move. To actuate the membrane 332, a piezoelectric stack 337 is deposited and patterned as shown. The stack 337 includes a piezoelectric material (e.g., PZT, KNN, ZnO) or other materials sandwiched between conductive electrodes 332 and 336. The membrane 332 itself can be used as one of the electrodes as shown in FIG. 3A, or alternatively, a separate conductive material 330 can be used for this electrode after depositing an insulating layer 331 to electrically decouple this electrode from the conductive membrane 332 as shown in the package substrate 370 of FIG. 3B. The next trace layer containing trace 350 (above the membrane layer 332) has an orifice 390 through which the flow is sucked in and expelled. To drive the membrane 332, a time varying (e.g., sinusoidal, square wave, etc) voltage signal is applied to the piezoelectric material 334, causing it to deform and producing alternating upward and downward vibration of the membrane. In the downward motion, fluid is sucked in from the environment. In the upward motion, "puffs" of fluid are generated and expelled through the orifice, entraining surrounding fluid during this process.

Figure 4:
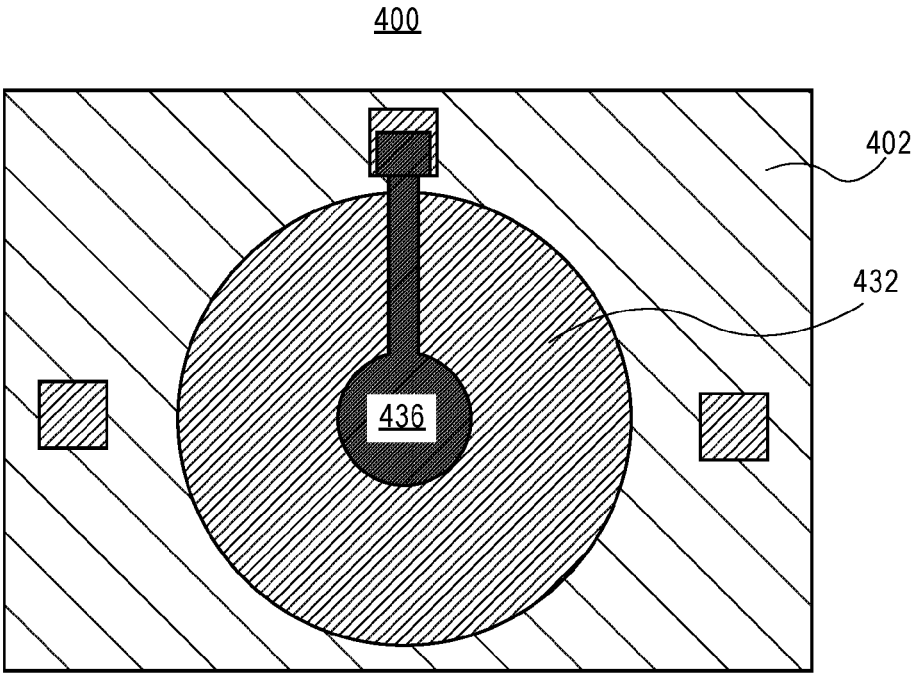
FIG. 4 illustrates a top view of a membrane layer of a synthetic jet device integrated in a package substrate 400 in accordance with one embodiment.

FIG. 4 illustrates a top view of a membrane layer of a synthetic jet device integrated in a package substrate 400 in accordance with one embodiment. The substrate 400 includes organic dielectric material 402 and a vibrating membrane 432 formed in a cavity. A conductive structure 436 acts as an upper electrode and the vibrating membrane 432 acts as a lower electrode of a piezoelectric stack of a jet device.

Figure 5:
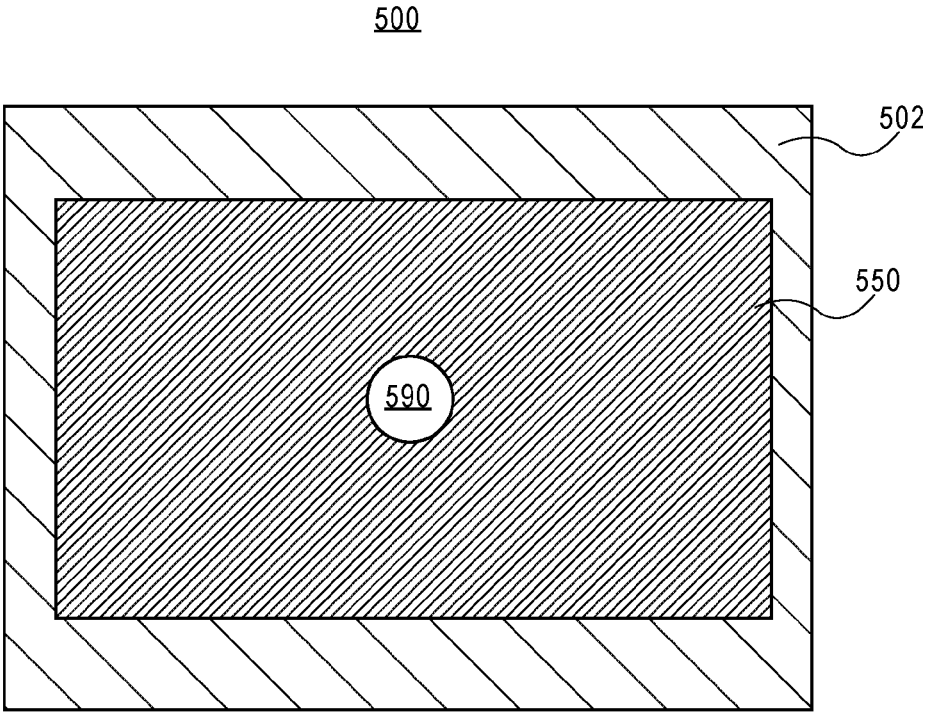
FIG. 5 illustrates a top view of an orifice layer of a synthetic jet device integrated in a package substrate 500 in accordance with one embodiment.

FIG. 5 illustrates a top view of an orifice layer of a synthetic jet device integrated in a package substrate 500 in accordance with one embodiment. The substrate 500 includes organic dielectric material 502 and a conductive structure orifice layer 550. A vibrating membrane 432 is positioned below the orifice layer 550. The vibrating membrane 432 generates "puffs" of fluid, which are expelled through the orifice 590. The jet flow is generated by entraining surrounding fluid with the puff.

Although the designs shown in FIGS. 4 and 5 include a circular orifice and a circular vibrating member, any other type of design (e.g., any lithographically defined feature, a triangle, a pentagon, a hexagon, etc.) is also possible. Moreover, the electrical connections between the electrodes of the piezoelectric stack and other traces or vias in the package can be either on one side of the vibrating structure (e.g., FIGS. 4 and 6) or distributed on different sides of the structure (e.g., FIG. 7).

Figure 6:
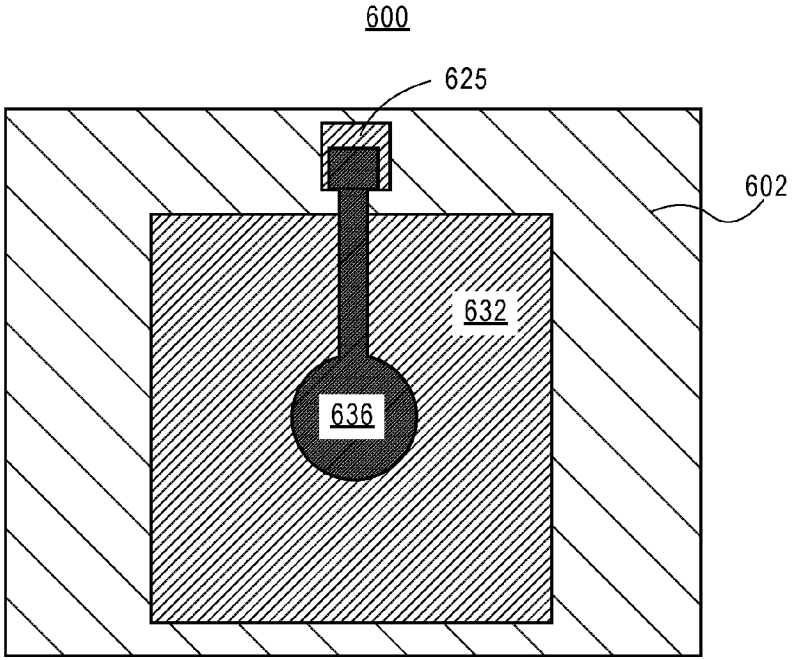
FIG. 6 illustrates a top view of a membrane layer of a synthetic jet device integrated in a package substrate 600 in accordance with one embodiment.

FIG. 6 illustrates a top view of a membrane layer of a synthetic jet device integrated in a package substrate 600 in accordance with one embodiment. The substrate 600 includes organic dielectric material 602, a vibrating membrane 632 formed in a cavity, and an electrical connection 625 for connecting to other traces or vias in the package. A conductive structure 636 acts as an upper electrode and the vibrating membrane 632 acts as a lower electrode of a piezoelectric stack of a jet device. In this example, membrane 632 is shown as a rectangular structure, but other designs (e.g., a triangle, a pentagon, a hexagon, etc.) are also possible.

Figure 7:
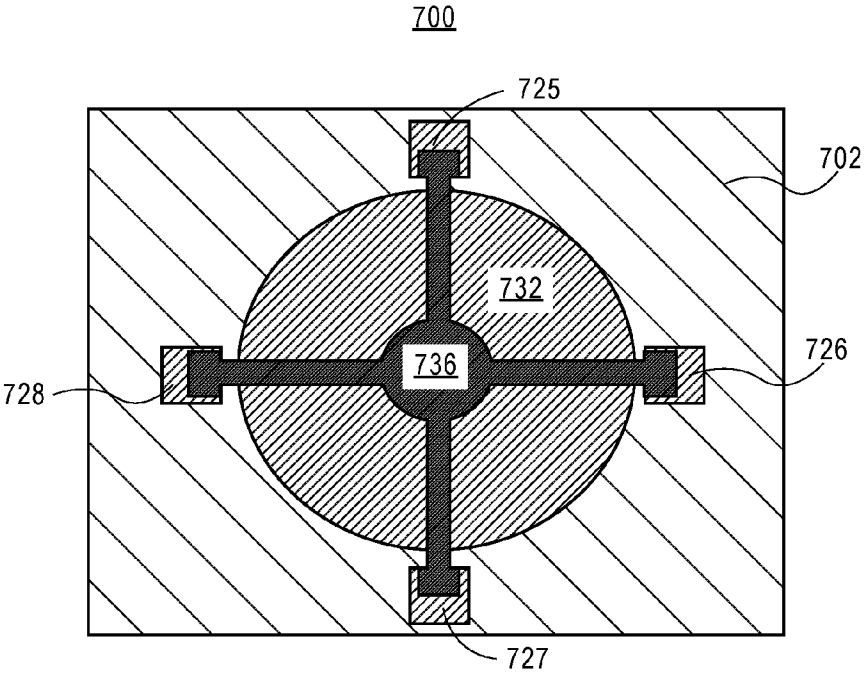
FIG. 7 illustrates a top view of a membrane layer of a synthetic jet device integrated in a package substrate 700 in accordance with another embodiment.

FIG. 7 illustrates a top view of a membrane layer of a synthetic jet device integrated in a package substrate 700 in accordance with another embodiment. The substrate 700 includes organic dielectric material 702, a vibrating membrane 732 formed in a cavity, and connections 725-728 for electrically connecting the device to other traces or vias in the package. A conductive structure 736 acts as an upper electrode and the vibrating membrane 732 acts as a lower electrode of a piezoelectric stack of a jet device.

Figure 8:
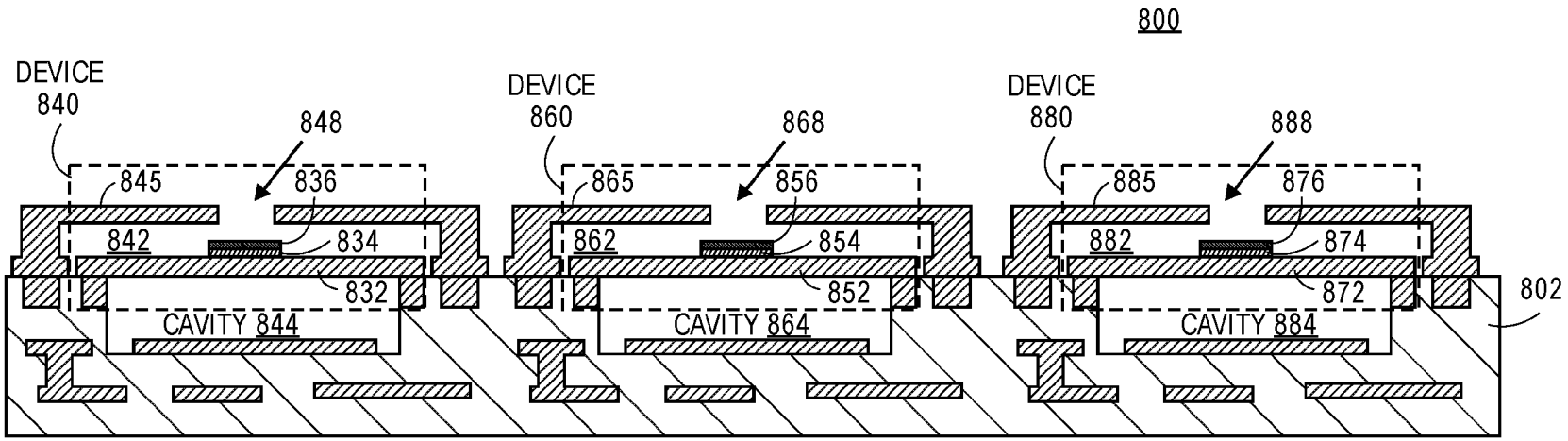
FIG. 8 illustrates a cross-sectional view of an array of synthetic jet devices integrated in a package substrate in accordance with one embodiment.

FIG. 8 illustrates a cross-sectional view of an array of synthetic jet devices integrated in a package substrate in accordance with one embodiment. A package substrate 800 includes an array of synthetic jet devices for generating fluid flow. The array can include any integer value of devices (e.g., n×m array with n and m being integer values). The device 840 includes a vibrating membrane 832 formed in a cavity 842 and a cavity 844 of an organic substrate 800 having organic dielectric material 802. The vibrating membrane 832 generates "puffs" of fluid, which are expelled through the orifice 848. The jet flow is generated by entraining surrounding fluid with the puff.

The membrane 832 is free to vibrate in a vertical direction (z-axis) and is surrounded by cavities on both sides (top and bottom). The membrane 832 can be patterned as part of one the substrate conductive trace layers and can include copper or other conductive material. Organic dielectric normally surrounds copper traces in packages/PCBs; however this organic material is removed around the membrane in FIG. 8 to allow the membrane 832 to move. To actuate the membrane 832, a piezoelectric stack is deposited and patterned as shown. The stack includes a piezoelectric material 834 (e.g., PZT, KNN, ZnO, etc.) or other materials sandwiched between conductive electrodes 832 and 836. The membrane 832 itself can be used as one of the electrodes as shown in FIG. 8, or alternatively, a separate conductive material can be used for this electrode after depositing an insulating layer to electrically decouple this electrode from the conductive membrane 832. The next trace layer containing trace 845 (above the membrane layer 832) has an orifice 848 through which the flow is sucked in and expelled. To drive the membrane 832, a time varying (e.g., sinusoidal, square wave, etc) voltage signal is applied to the piezoelectric material 834, causing it to deform and producing alternating upward and downward vibration of the membrane. In the downward motion, fluid is sucked in from the environment. In the upward motion, "puffs" of fluid are generated and expelled through the orifice, entraining surrounding fluid during this process.

The devices 860 and 880 include similar components and function in a similar manner in comparison to the device 840. The device 860 includes cavities 864 and 862, membrane 852 which acts as a first electrode of a piezoelectric stack, piezoelectric material 854, conductive structure 856 which acts as a second electrode of the piezoelectric stack, orifice 868, and conductive structure 865 (or conductive trace). The device 880 includes cavities 884 and 882, membrane 872 which acts as a first electrode of a piezoelectric stack, piezoelectric material 874, conductive structure 876 which acts as a second electrode of the piezoelectric stack, orifice 888, and conductive structure 885 (or conductive trace).

In one example, any number of devices can be actuated to create various different flow rates (e.g., in terms of volume per time or mass per time). An array of micro-pump devices with different feature sizes and different individual flow rates can be used to create a wide range of possible total flow rates depending on which pumps or combinations of pumps are actuated. In a specific example, 4 different pumps (e.g. with individual flow rates of 1x, 2x, 4x, 8x, where x is a nominal flow rate value) can be used to obtain 16 possible values of total flow rate (e.g., 0 being a first value when no pumps are actuated, 1x being a second value when only the first pump with flow rate 1x is actuated, 2x being a third value when only the second pump with flow rate 2x is actuated, 3x being a fourth value when the first two pumps with individual flow rates 1x and 2x are actuated, . . . , 15x being a sixteenth value when all four pumps are actuated). Different individual flow rates for each pump can be achieved by appropriately designing the different features of each jet device including orifice dimensions, orifice shape, cavity size, membrane thickness, etc.

It will be appreciated that, in a system on a chip embodiment, the die may include a processor, memory, communications circuitry and the like. Though a single die is illustrated, there may be none, one or several dies included in the same region of the microelectronic device.

In one embodiment, the microelectronic device may be a crystalline substrate formed using a bulk silicon or a silicon-on-insulator substructure. In other implementations, the microelectronic device may be formed using alternate materials, which may or may not be combined with silicon, that include but are not limited to germanium, indium antimonide, lead telluride, indium arsenide, indium phosphide, gallium arsenide, indium gallium arsenide, gallium antimonide, or other combinations of group III-V or group IV materials. Although a few examples of materials from which the substrate may be formed are described here, any material that may serve as a foundation upon which a semiconductor device may be built falls within the scope of the present invention.

The microelectronic device may be one of a plurality of microelectronic devices formed on a larger substrate, such as, for example, a wafer. In an embodiment, the microelectronic device may be a wafer level chip scale package (WLCSP). In certain embodiments, the microelectronic device may be singulated from the wafer subsequent to packaging operations, such as, for example, the formation of one or more piezoelectric vibrating devices.

One or more contacts may be formed on a surface of the microelectronic device. The contacts may include one or more conductive layers. By way of example, the contacts may include barrier layers, organic surface protection (OSP) layers, metallic layers, or any combination thereof. The contacts may provide electrical connections to active device circuitry (not shown) within the die. Embodiments of the invention include one or more solder bumps or solder joints that are each electrically coupled to a contact. The solder bumps or solder joints may be electrically coupled to the contacts by one or more redistribution layers and conductive vias.

Figure 9:
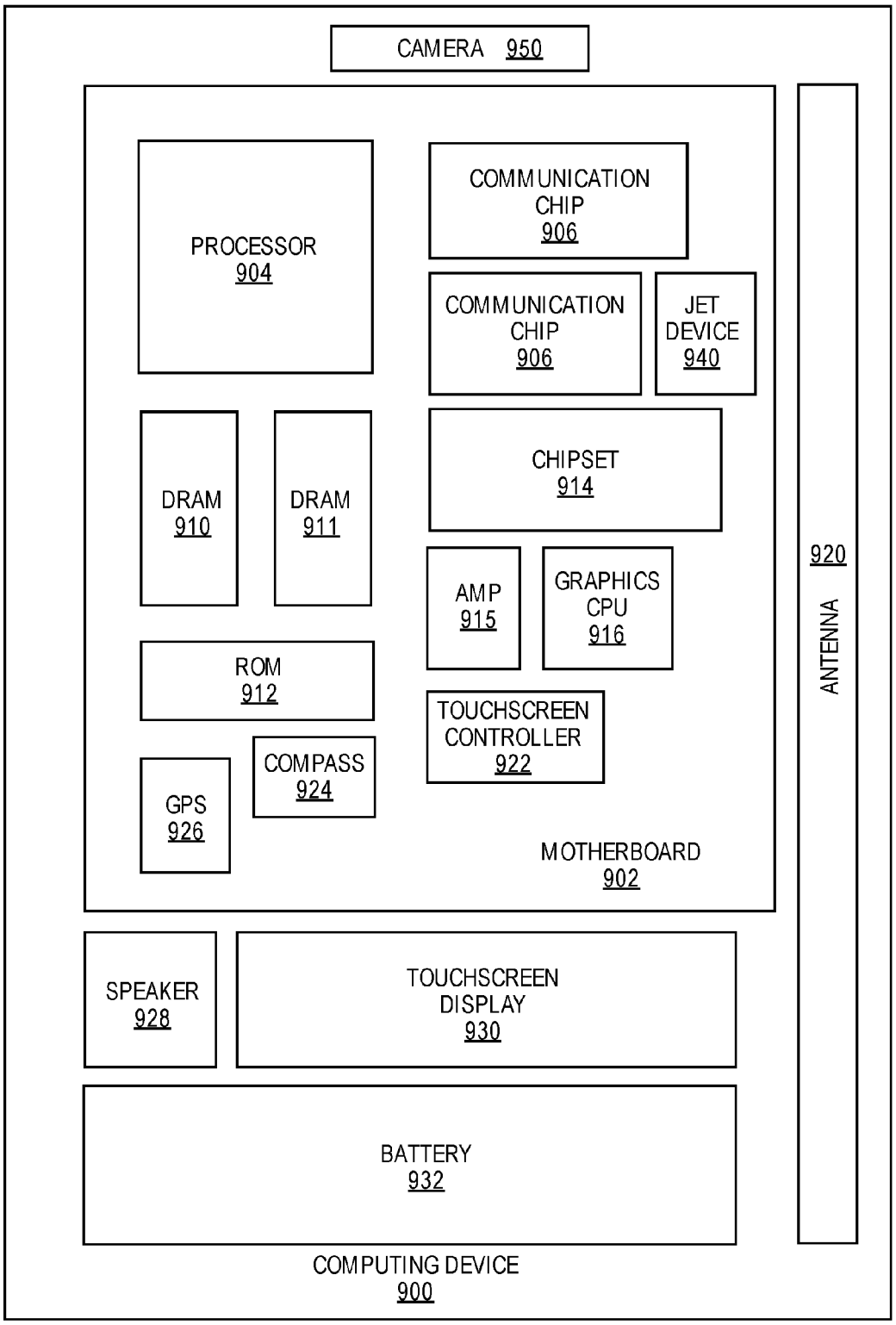
FIG. 9 illustrates a computing device 900 in accordance with one embodiment.

FIG. 9 illustrates a computing device 900 in accordance with one embodiment of the invention. The computing device 900 houses a board 902. The board 902 may include a number of components, including but not limited to a processor 904 and at least one communication chip 906. The processor 904 is physically and electrically coupled to the board 902. In some implementations the at least one communication chip 906 is also physically and electrically coupled to the board 902. In further implementations, the communication chip 906 is part of the processor 904.

Depending on its applications, computing device 900 may include other components that may or may not be physically and electrically coupled to the board 902. These other components include, but are not limited to, volatile memory (e.g., DRAM 910, 911), non-volatile memory (e.g., ROM 912), flash memory, a graphics processor 916, a digital signal processor, a crypto processor, a chipset 914, an antenna 920, a display, a touchscreen display 930, a touchscreen controller 922, a battery 932, an audio codec, a video codec, a power amplifier 915, a global positioning system (GPS) device 926, a compass 924, a jet device 940 (e.g., a piezoelectric jet micro-pump device), a gyroscope, a speaker, a camera 950, and a mass storage device (such as hard disk drive, compact disk (CD), digital versatile disk (DVD), and so forth).

The communication chip 906 enables wireless communications for the transfer of data to and from the computing device 900. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 906 may implement any of a number of wireless standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 3G, 4G, 5G, and beyond. The computing device 900 may include a plurality of communication chips 906. For instance, a first communication chip 906 may be dedicated to shorter range wireless communications such as Wi-Fi, WiGig and Bluetooth and a second communication chip 906 may be dedicated to longer range wireless communications such as GPS, EDGE, GPRS, CDMA, WiMAX, LTE, Ev-DO, 5G, and others.

The processor 904 of the computing device 900 includes an integrated circuit die packaged within the processor 904. In some implementations of the invention, the processor package includes one or more devices, such as jet devices in accordance with implementations of embodiments of the invention. The term "processor" may refer to any device or portion of a device that processes electronic data from registers and/or memory to transform that electronic data into other electronic data that may be stored in registers and/or memory. The communication chip 906 also includes an integrated circuit die packaged within the communication chip 906. The following examples pertain to further embodiments.

Example 1 is a jet device, comprising a vibrating membrane positioned between first and second cavities of an organic substrate, a piezoelectric material coupled to the vibrating membrane which acts as a first electrode, and a second electrode in contact with the piezoelectric material. The vibrating membrane generates a fluid flow through an orifice in response to application of an electrical signal between the first and second electrodes.

In example 2, the subject matter of example 1 can optionally include the jet device being integrated with the organic substrate which is fabricated with panel level processing.

In example 3, the subject matter of any of examples 1-2 can optionally include the vibrating membrane being positioned above the first cavity and below the second cavity of the organic substrate to allow vibrations of the vibrating membrane.

In example 4, the subject matter of any of examples 1-3 can optionally include the jet device being designed with a Helmholtz frequency of the second cavity approximately matching a resonant frequency of the vibrating membrane and a frequency of the electrical signal.

In example 5, the subject matter of any of examples 1-4 can optionally include the vibrating membrane having any type of in-plane shape defined by lithography during the panel level fabrication of the organic substrate.

In example 6, the subject matter of any of examples 1-5 can optionally include the vibrating membrane upon application of the electrical signal alternating between upward and downward vibration with the upward vibration causing fluid flow to be expelled through the orifice to an environment and the downward vibration causing fluid flow to be pulled in through the orifice from the environment. Example 7 is a package substrate comprising a plurality of organic dielectric layers and a plurality of conductive layers to form the package substrate, a cavity formed in the package substrate, and a piezoelectric micro-pump device integrated with the package substrate. The piezoelectric micro-pump device including a first electrode, a piezoelectric material in contact with the first electrode, and a second electrode in contact with the piezoelectric material. The piezoelectric micro-pump device is suspended with respect to the cavity of the organic substrate and the piezoelectric micro-pump device generates a fluid flow caused by an application of an electrical signal between the first and second electrodes.

In example 8, the subject matter of example 7 can optionally include the first electrode comprising a vibrating membrane that upon application of the electrical signal alternates between upward and downward vibration with the upward vibration causing fluid flow to be expelled through an orifice to an environment and the downward vibration causing fluid flow to be pulled in through the orifice from the environment.

In example 9, the subject matter of any of examples 7-8 can optionally include the vibrating membrane being positioned within the cavity of the package substrate to allow vibrations of the vibrating membrane.

In example 10, the subject matter of any of examples 7-9 can optionally include a vibrating membrane, an insulating layer coupled to the vibrating membrane, and the first electrode interposed between the insulating layer and the piezoelectric material.

In example 11, the subject matter of any of examples 7-10 can optionally include the package substrate being fabricated with panel level processing.

Example 12 is a microelectronic device comprising a plurality of organic dielectric layers, a plurality of conductive layers to form an organic substrate, and an array of piezoelectric micro-pump devices integrated with the organic substrate. The piezoelectric micro-pump devices each include a first electrode, a piezoelectric material in contact with the first electrode, and a second electrode in contact with the piezoelectric material. Each piezoelectric micro-pump device is capable of generating a fluid flow caused by an application of an electrical signal between the first and second electrodes. The array of piezoelectric micro-pump devices includes n different sizes of micro-pump devices with n being an integer.

In example 13, the subject matter of example 12 can optionally include the first electrode of each micro-pump device comprising a vibrating membrane that upon application of the electrical signal alternates between upward and downward vibration with the upward vibration causing fluid flow to be expelled through an orifice to an environment and the downward vibration causing fluid flow to be pulled in through the orifice from the environment.

In example 14, the subject matter of any of examples 12-13 can optionally include the vibrating membrane being positioned within a cavity of the organic substrate to allow vibrations of the vibrating membrane.

In example 15, the subject matter of any of examples 12-14 can optionally include each micro-pump device further comprising a vibrating membrane, an insulating layer coupled to the vibrating membrane, and a first electrode interposed between the insulating layer and the piezoelectric material.

In example 16, the subject matter of any of examples 12-15 can optionally include the organic substrate being fabricated with panel level processing.

Example 17 is a computing device comprising at least one processor to process data and a package substrate coupled to the at least one processor. The package substrate includes a plurality of organic dielectric layers and a plurality of conductive layers to form the package substrate. A piezoelectric jet device having a vibrating membrane is positioned between first and second cavities of the package substrate. A piezoelectric material is coupled to the vibrating membrane which acts as a first electrode and a second electrode is in contact with the piezoelectric material. The vibrating membrane generates a fluid flow through an orifice in response to application of an electrical signal between the first and second electrodes. In example 18, the subject matter of example 17 can optionally include the jet device being integrated with the package substrate which is fabricated with panel level processing.

In example 19, the subject matter of any of examples 17-18 can optionally include the vibrating membrane being positioned above the first cavity and below the second cavity of the package substrate to allow vibrations of the vibrating membrane.

In example 20, the subject matter of any of examples 17-19 can optionally include a printed circuit board coupled to the package substrate.

The invention claimed is:

1. A jet device, comprising:

a vibrating membrane positioned between first and second cavities of an organic substrate;

a piezoelectric material coupled to the vibrating membrane, wherein the vibrating membrane acts as a first electrode; and a second electrode in contact with the piezoelectric material, wherein the vibrating membrane generates a fluid flow through an orifice in response to application of an electrical signal between the first and second electrodes.

2. The jet device of claim 1, wherein the jet device is integrated with the organic substrate and wherein the organic substrate is fabricated with panel level processing.

3. The jet device of claim 1, wherein the vibrating membrane is positioned above the first cavity and below the second cavity of the organic substrate to allow vibrations of the vibrating membrane.

4. The jet device of claim 3, wherein a Helmholtz frequency of the second cavity approximately matches a resonant frequency of the vibrating membrane and a frequency of the electrical signal.

5. The jet device of claim 1, wherein the vibrating membrane has any type of in-plane shape defined by lithography during panel level fabrication of the organic substrate.

6. The jet device of claim 1, wherein, upon application of the electrical signal, the vibrating membrane alternates between upward and downward vibration with the upward vibration causing fluid flow to be expelled through the orifice to an environment and the downward vibration causing fluid flow to be pulled in through the orifice from the environment.

7. A organic package substrate comprising:

a plurality of organic dielectric layers and a plurality of conductive layers to form the organic package substrate;

first and second cavities formed in the organic package substrate; and a piezoelectric micro-pump device integrated with the organic package substrate, the piezoelectric micro-pump device including a first electrode, a piezoelectric material in contact with the first electrode, and a second electrode in contact with the piezoelectric material, wherein the piezoelectric micro-pump device is suspended with respect to the first and second cavities of the organic package substrate and wherein the piezoelectric micro-pump device generates a fluid flow caused by an application of an electrical signal between the first and second electrodes.

8. The organic package substrate of claim 7, wherein the first electrode comprises a vibrating membrane and wherein, upon application of the electrical signal, the Vibrating membrane alternates between upward and downward vibration with the upward vibration causing fluid flow to be expelled through an orifice to an environment and the downward vibration causing fluid flow to be pulled in through the orifice from the environment.

9. The organic package substrate of claim 8, wherein the vibrating membrane is positioned above the first cavity and below the second cavity of the organic package substrate to allow vibrations of the vibrating membrane.

10. The organic package substrate of claim 7, further comprising:

a vibrating membrane;

an insulating layer coupled to the vibrating membrane; and the first electrode interposed between the insulating layer and the piezoelectric material.

11. The organic package substrate of claim 7, wherein the organic package substrate is fabricated with panel level processing.

12. A microelectronic device comprising:

a plurality of organic dielectric layers and a plurality of conductive layers to form an organic substrate; and an array of piezoelectric micro-pump devices integrated with the organic substrate, each of the piezoelectric micro-pump devices including a first electrode, a piezoelectric material in contact with the first electrode, and a second electrode in contact with the piezoelectric material, wherein each piezoelectric micro-pump device is capable of generating a fluid flow caused by an application of an electrical signal between the first and second electrodes and wherein the array of piezoelectric micro-pump devices includes n different sizes of micro-pump devices with n being an integer.

13. The microelectronic device of claim 12, wherein the first electrode of each micro-pump device comprises a vibrating membrane and wherein, upon application of the electrical signal, the vibrating membrane alternates between upward and downward vibration with the upward vibration causing fluid flow to be expelled through an orifice to an environment and the downward vibration causing fluid flow to be pulled in through the orifice from the environment.

14. The microelectronic device of claim 13, wherein the vibrating membrane is positioned above a first cavity and below a second cavity of the organic substrate to allow vibrations of the vibrating membrane.

15. The microelectronic device of claim 12, wherein each micro-pump device further comprises:

a vibrating membrane;

an insulating layer coupled to the vibrating membrane; and a first electrode interposed between the insulating layer and the piezoelectric material.

16. The microelectronic device of claim 12, wherein the organic substrate is fabricated with panel level processing.

17. A computing device comprising:

at least one processor to process data; and an organic package substrate coupled to the at least one processor, the organic package substrate including:

a plurality of organic dielectric layers and a plurality of conductive layers to form the organic package substrate, a piezoelectric jet device having a vibrating membrane positioned between first and second cavities of the organic package substrate, a piezoelectric material coupled to the vibrating membrane, wherein the vibrating membrane acts as a first electrode, and a second electrode in contact with the piezoelectric material, wherein the vibrating membrane generates a fluid flow through an orifice in response to application of an electrical signal between the first and second electrodes.

18. The computing device of claim 17, wherein the jet device is integrated with the organic package substrate and wherein the organic package substrate is fabricated with panel level processing.

19. The computing device of claim 17, wherein the vibrating membrane is positioned above the first cavity and below the second cavity of the organic package substrate to allow vibrations of the vibrating membrane.

20. The computing device of claim 17, further comprising:

a printed circuit board coupled to the organic package substrate.

* * * * *